US006145479A

United States Patent [19]

Rotter

[11] Patent Number: 6,145,479

[45] Date of Patent: Nov. 14, 2000

[54] VERTICAL SHAFT ENGINE COOLING APPARATUS

[75] Inventor: Terrence M. Rotter, Sheboygan Falls, Wis.

[73] Assignee: Kohler Co., Kohler, Wis.

[21] Appl. No.: 09/252,368

[22] Filed: Feb. 18, 1999

[51] Int. Cl.[7] ..... F01P 7/10

[52] U.S. Cl. ..... 123/41.49; 123/41.11

[58] Field of Search ..... 123/41.11, 41.49; 165/41, 51, 125

[56] References Cited

U.S. PATENT DOCUMENTS

| | | | |
|---|---|---|---|
| 778,152 | 12/1904 | Soller et al. . | |
| 872,427 | 12/1907 | Hullinghorst . | |
| 884,929 | 4/1908 | Hullinghorst . | |
| 914,822 | 3/1909 | Goudard et al. . | |
| 1,013,449 | 1/1912 | Ruthenberg . | |
| 1,271,191 | 7/1918 | Masury . | |
| 1,390,899 | 9/1921 | Froelich . | |
| 1,417,026 | 5/1922 | Caps . | |
| 1,417,037 | 5/1922 | Cushman . | |
| 1,421,221 | 6/1922 | Harter . | |
| 1,517,919 | 12/1924 | Rushmore . | |
| 2,159,599 | 5/1939 | Morrison | 123/174 |
| 3,642,062 | 2/1972 | Edmaier et al. | 165/125 |
| 3,698,473 | 10/1972 | Frank et al. | 165/51 |
| 3,800,866 | 4/1974 | Ireland et al. | 165/122 |
| 3,921,603 | 11/1975 | Bentz et al. | 123/41.33 |
| 4,059,080 | 11/1977 | Rudert | 123/41.33 |
| 4,062,401 | 12/1977 | Rudny et al. | 165/125 |
| 4,120,271 | 10/1978 | Edmaier | 123/41.49 |
| 4,136,735 | 1/1979 | Beck et al. | 165/125 |
| 4,180,130 | 12/1979 | Beck et al. | 165/124 |
| 4,184,541 | 1/1980 | Beck et al. | 165/125 |
| 4,202,296 | 5/1980 | Nonnenmann et al. | 123/41.49 |
| 4,357,914 | 11/1982 | Hauser | 123/41.49 |
| 4,377,203 | 3/1983 | Ejima | 165/125 |
| 4,658,767 | 4/1987 | Fujikawa et al. | 123/196 W |
| 4,681,067 | 7/1987 | Tamba et al. | 123/41.1 |
| 4,756,280 | 7/1988 | Tamba et al. | 123/41.47 |
| 5,078,206 | 1/1992 | Goetz, Jr. | 123/41.49 |
| 5,172,752 | 12/1992 | Goetz, Jr. | 123/41.49 |
| 5,755,194 | 5/1998 | Moorman et al. | 123/196 W |

*Primary Examiner*—Erick Solis
*Assistant Examiner*—Jason Benton
*Attorney, Agent, or Firm*—Quarles & Brady LLP

[57] ABSTRACT

The present invention provides a cooling apparatus for use with a liquid cooled vertical shaft internal combustion engine with a centrifugal fan having a central axis which is driven by the engine vertical shaft. A radiator having a coolant passing therethrough encircles the fan for an improved heat transfer rate. An air duct channels cooling air expelled by the fan toward the radiator to cool the coolant.

29 Claims, 5 Drawing Sheets

FIG. 4
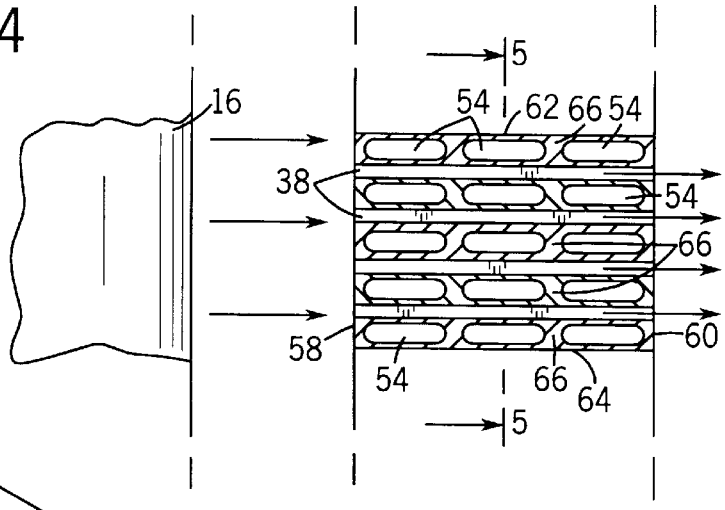
FIG. 6
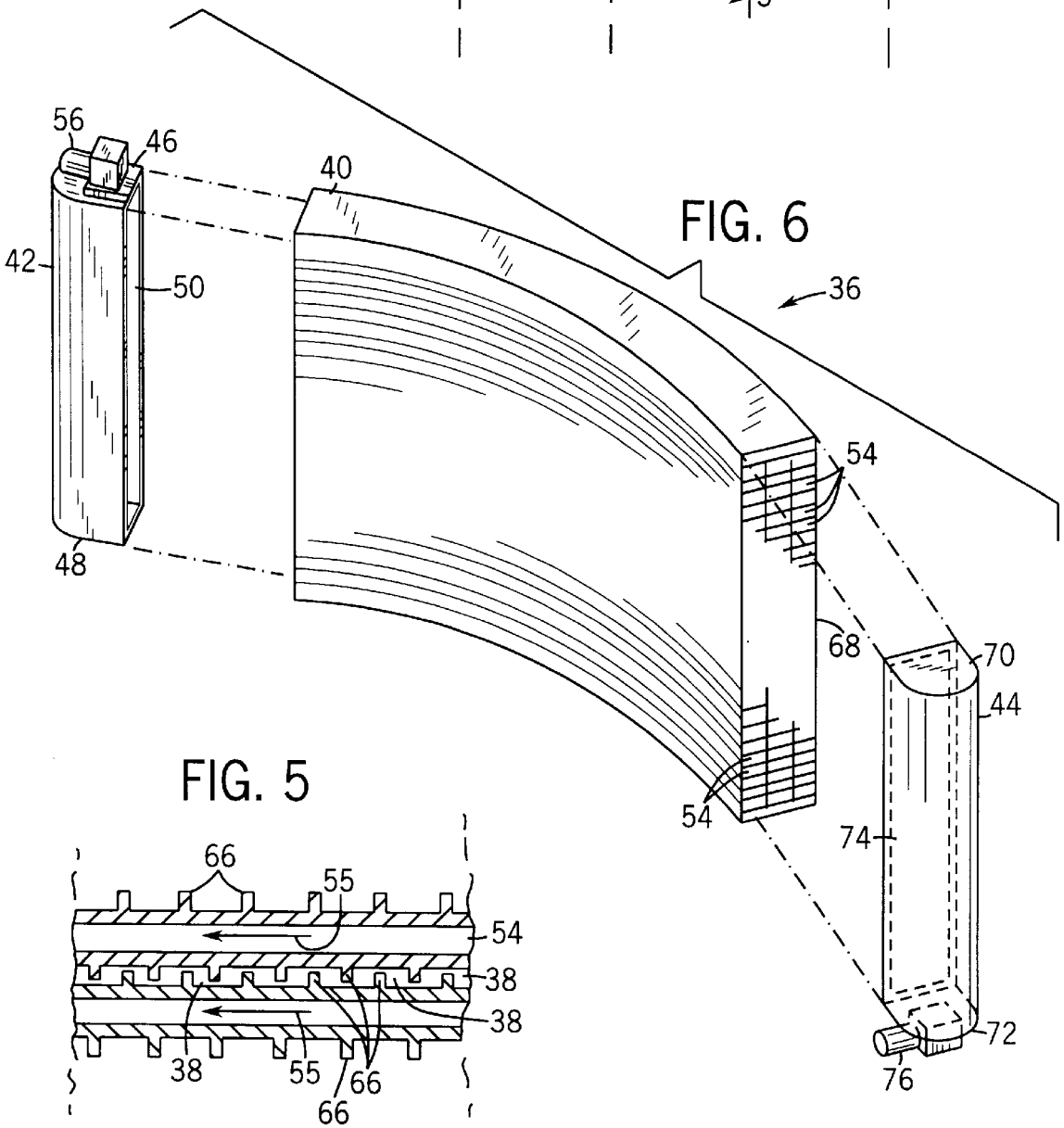
FIG. 5

VERTICAL SHAFT ENGINE COOLING APPARATUS

FIELD OF THE INVENTION

The field of the invention relates to engine cooling, more particularly to a cooling a compact vertical shaft internal combustion engine having a radiator.

DESCRIPTION OF THE BACKGROUND ART

Vertical shaft internal combustion engines are becoming increasingly popular for use in lawn tractors. Their vertical shaft drives grass cutting blades without the use of a costly transmission. Consumer preferences, however, currently dictate lawn tractors with a low hood line. In a vertical shaft engine, this requires a short compact configuration. Even in larger tractors, such as those requiring an engine having 16 hp –35 hp, a low hood line is important to consumers. These larger engines, generate a significant amount of heat during operation and are typically liquid cooled. Liquid cooled vertical shaft engine are not easily shortened because of the necessity of a radiator to cool the liquid cooling the engine.

A liquid cooled engine radiator should be exposed to an air flow in order to operate properly. This radiator must include sufficient surface area in order to adequately cool the engine. In a typical vertical shaft engine, such as shown in U.S. Pat. No. 4,756,280, the radiator has a generally flat, rectangular shape and is disposed above an axial fan mounted on the engine vertical shaft. The shaft rotation causes the axial fan to draw air through the radiator to enhance the rate of heat transfer. This configuration requires a space between the radiator and engine for the fan which increases the overall height of the engine. In addition, sufficient space must be provided to allow the fan to generate an air flow, further increasing the engine height.

Furthermore, a flat radiator with an axial flow fan has a high heat transfer efficiency within the radiator area defined by the fan diameter. However, the area of the radiator outside of the fan diameter, such as the radiator corners, has a significantly lower heat transfer efficiency. In order to provide sufficient cooling, the radiator, must therefore be sized large enough to take into account the varying heat transfer efficiencies in the radiator.

In order to overcome varying heat transfer efficiencies across a flat radiator, round radiators in cooperation with an axial fan have been disclosed, such as in U.S. Pat. No. 4,136,735. In this patent, a round radiator encircles a plenum. An axial fan disposed at the plenum edge either pressurizes the plenum forcing air through the radiator, or creates a suction in the plenum drawing air through the plenum. When the axial fan is adapted to pressurize the plenum, guides disposed about the fan periphery aid the fan in diverting the axial flow of air through the fan to a radial air flow toward the radiator. The round radiator may have an improved heat transfer efficiency in comparison to a flat radiator. However, the plenum in cooperation with the axial fan does not provide a compact engine because of the space requirements for the plenum and fan which increases the overall length or height of the engine.

Therefore, it is desirable to provide a cooling apparatus for a liquid cooled vertical shaft internal combustion engine which provides efficient heat transfer and a compact engine.

SUMMARY OF THE INVENTION

The present invention provides a cooling apparatus for use with a liquid cooled vertical shaft internal combustion engine with a centrifugal fan having a central axis which is driven by the engine vertical shaft. A radiator having a coolant passing therethrough is mounted on the engine and encircles the fan. An air duct channels cooling air expelled radially outward by the fan toward the radiator to cool the coolant.

An objective of the present invention is to provide a compact liquid cooled vertical shaft internal combustion engine. This is accomplished by providing a cooling apparatus having a radiator encircling a centrifugal fan mounted to the engine vertical shaft. The radiator is disposed in the same plane as the fan, thus reducing the overall height of the engine.

Another objective of the present invention is to provide an efficient cooling apparatus for a vertical shaft internal combustion engine. This is accomplished by providing an annular shaped radiator which encircles the fan and receives cooling air therefrom uniformly. This arrangement provides a relatively uniform heat transfer efficiency throughout the entire heat transfer surface area of the radiator.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 4 is a sectional view of the radiator along line 4—4 of FIG. 3;

FIG. 5 is a sectional view of the radiator along line 5—5 of FIG. 4;

FIG. 6 is an exploded view of the radiator of FIG. 1;

DETAILED DESCRIPTION OF THE PREFERRED EMBODIMENTS

Figure 1:
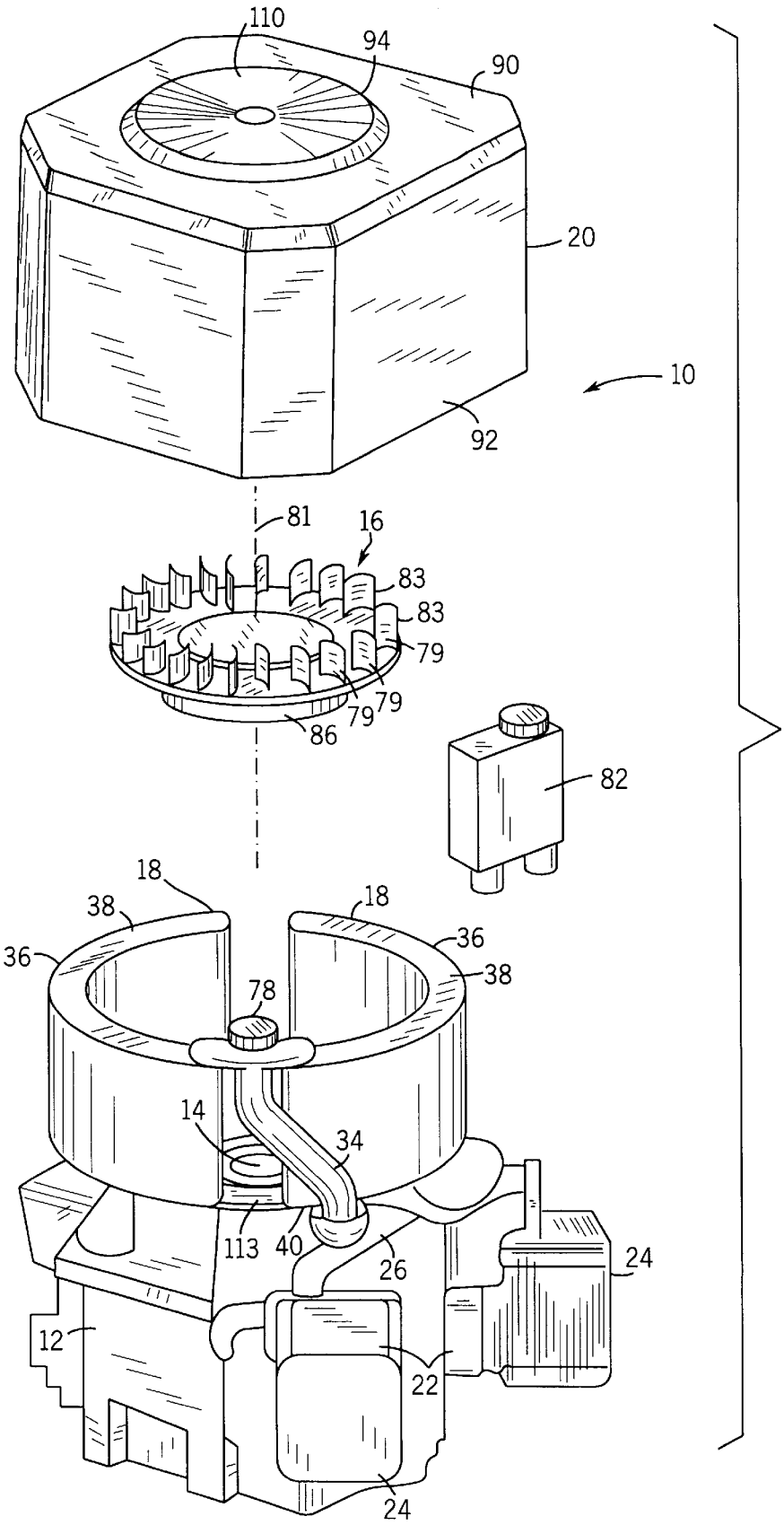
FIG. 1 is an exploded perspective view of an engine incorporating the preferred embodiment of the present invention.
Figure 2:
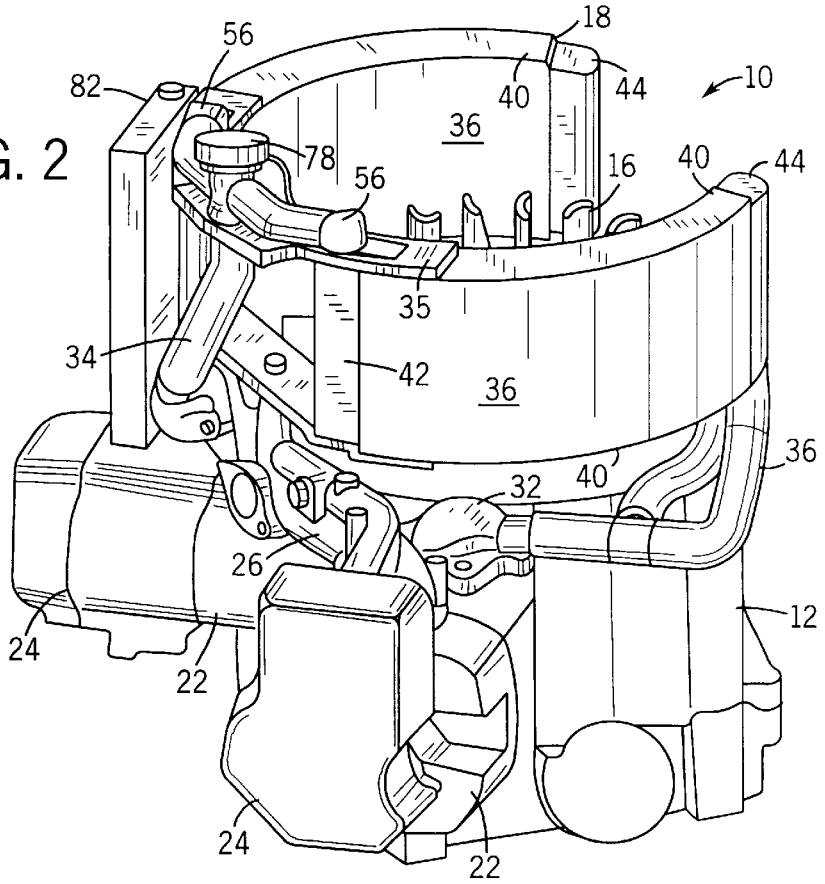
FIG. 2 is a perspective view of the engine of FIG. 1 with the air duct removed.

Referring to FIGS. 1 and 2, the major elements of a vertical shaft internal combustion engine 10 include a cylinder block 12 with a rotatably mounted vertical shaft 14, a centrifugal fan 16 mounted on the shaft 14 and above the cylinder block 12, a radiator 18 encircling the fan 16, and an air duct 20 enclosing the fan 16 and radiator 18. The internal combustion engine 10 is liquid cooled by forcing a coolant, such as water, through a cooling circuit which includes the cylinder block 12 and the radiator 18.

The cylinder block 12 has two cylinders 22 each having a head 24 disposed at one end. The cylinders 22 receive reciprocating pistons (not shown) which are driven by the vertical drive shaft 14. Operation of the internal combustion engine 10 generates heat in the cylinders 22 which heats the entire cylinder block 12. In order to cool the cylinders 22, coolant flows in passageways (not shown) surrounding each cylinder 22 and in each cylinder head 24. Although a two cylinder engine is described herein, the engine may have any number of cylinders without departing from the scope of the present invention.

Figure 3:
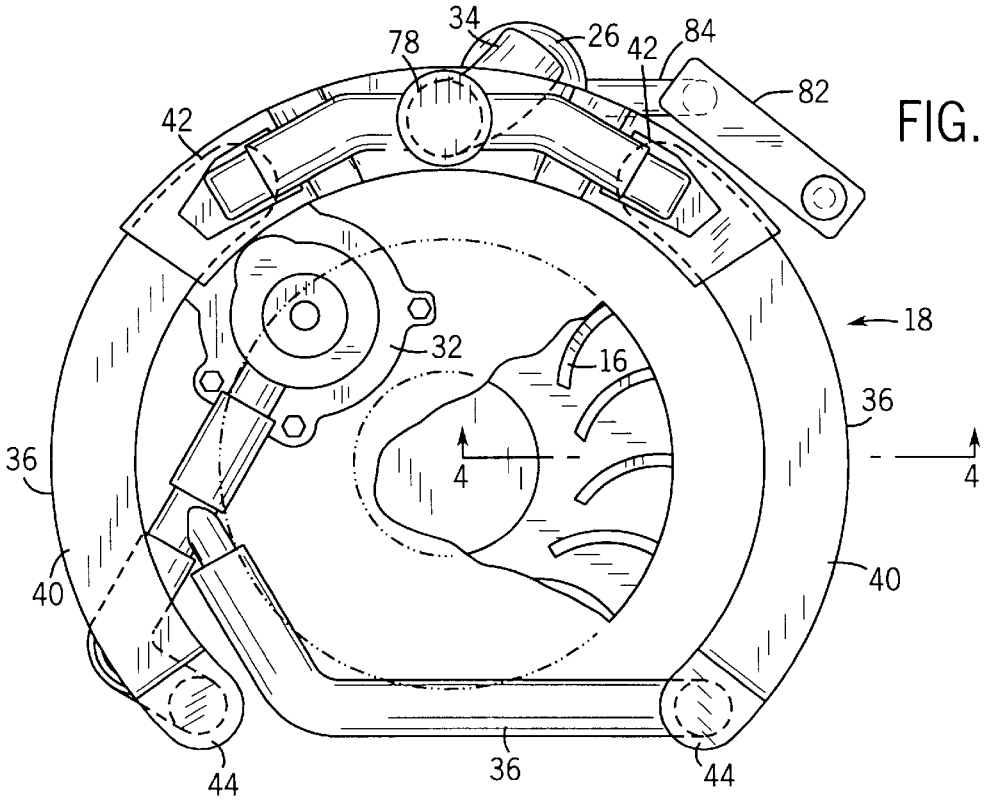
FIG. 3 is cut away top view of the engine of FIG. 2.

Referring to FIGS. 2 and 3, the passageways in the engine 10 form part of a cooling circuit which includes a manifold 26, thermostat (not shown), radiator 18 and a coolant pump 32. The cooling circuit defines a path for the coolant as it is subjected to a continuous heating and cooling cycle for cooling the engine 10.

The coolant in the passageways is heated by the engine 10 and flows from the passageways into the manifold 26. The manifold 26 receives the coolant from the passageways in all of the cylinders 22 and cylinder heads 24 and channels it past the thermostat valve. The heated coolant from all the passageways is combined in the manifold 26 reducing any pressure fluctuations in the cooling circuit generated from any particular passageway.

The thermostat valve disposed in the manifold 26 increases or decreases the flow of coolant through the circuit in response to the engine temperature. If the engine temperature falls below a certain threshold temperature, the flow of coolant through the circuit is decreased. If the engine temperature rises above a threshold temperature the flow of coolant through the circuit is increased. By controlling the flow of coolant through the circuit, the thermostat valve maintains the operating temperature of the engine within a desired operating temperature range.

As shown in FIGS. 1–3, the radiator 18 is formed from two annular segments 36 and receives the heated coolant through a radiator hose 34 extending from the manifold 26. The annular segments 36 are mounted to the cylinder block 12 and substantially encircle the centrifugal fan 16. The annular segments 36 are connected to the cooling circuit in parallel to quickly cool the flowing coolant. Providing annular segments 36 is preferred because the segments 36 are easier to manufacture than a single annulus. Alternative shapes, such as a polygon, dome, cone, or segments thereof, may be used to encircle the fan without departing from the scope of the present invention.

As shown in FIG. 6, each radiator segment 36 is formed from conventional materials using methods known in the art and has a cooling section 40 interposed between an inlet chamber 42, and an outlet chamber 44. Heated coolant flows from the manifold 26 into the inlet chamber 42 and is cooled as it passes through the cooling section 40 prior to discharging into the outlet chamber 44.

The inlet chamber 42 is joined to one end of the cooling section 40 and forms a plenum which ensures steady even flow through the cooling section 40. The inlet chamber 42 has a top 46, bottom 48, and an open side 50 which opens to coolant passages 54 formed in the cooling section 40. The top 46 has a coolant inlet port 56 for receiving the coolant into the chamber 42. Coolant received in the chamber 42 flows through the chamber open side 50 into the cooling section passages 54.

Coolant flowing through the cooling section 40 is cooled by convection, conduction, and radiation. Referring particularly to FIGS. 4 and 5, the cooling section 40 extends from the inlet chamber 42 to the outlet chamber 44 having an inner wall 58, outer wall 60, top 62, bottom 64, coolant passages 54, and airways 38. The coolant passages 54 provide a path for the coolant from the inlet chamber 42 to the outlet chamber 44 past the airways 38. Fins 66 formed on the exterior of each passage 54 extend into the cooling section airways 38 to enhance convective cooling of the coolant.

Air forced through the airways 38 by the centrifugal fan 16 increases the radiator heat transfer efficiency providing a more compact radiator 18. The airways 38 are interposed between the passages 54 and are substantially perpendicular to the coolant flow direction 55 in the coolant passages 54. Cooling air radially expelled by the fan 16 passes through the airways 38 which extend substantially radially away from the centrifugal fan 16 from the cooling section inner wall 58 to the outer wall 60. As air flows through the airways 38, heat from the coolant transfers to the air by conduction, convection, and radiation.

The outlet chamber 44 encloses the exhaust end 68 of the cooling section 40 and receives the cooled coolant discharged from the coolant passages 58. The outlet chamber 44 has a top 70, bottom 72, and open side 74. The coolant enters the outlet chamber 44 through the open side 74 and is discharged through a discharge port 76 disposed at the chamber bottom 72. As in the inlet chamber 42, the outlet chamber 44 forms a plenum with the cooling section 40 which reduces pressure fluctuations in the radiator 18.

As shown in FIGS. 1–3, the radiator 18 encircles the fan 16 which forces cooling air through airways 38 formed in the radiator 18 to cool the coolant. By encircling the fan 16 with the radiator 18, the radiator heat transfer efficiency is increased by exposing all of the airways 38 to the same fan air flow. This is unlike a flat radiator with an axial flow fan in which the majority of the cooling air flows within the diameter of the cooling fan and circulates more cooling air through the center of the radiator. Thus, the heat transfer surface area, and therefore the overall size, of an encircling radiator is less than a flat radiator having an equivalent heat rejection rate.

The encircling annular radiator 18 allows considerable design flexibility. Advantageously, by radially forcing air through the airways 38, the height of the radiator 18 may be decreased merely by increasing the distance between the cooling section inner wall 58 and outer wall 60 without decreasing the heat transfer rate of the radiator 18. Reducing the height decreases the number of airways 38 in the radiator 18 reducing the heat transfer surface area, however increasing the length of each airway 38 compensates for the lost airways by increasing the heat transfer surface area in each airway 38.

Referring to FIG. 3, once the coolant is cooled by passing through the radiator 18, it exits the radiator outlet chamber 44 through the discharge port 76. Radiator hoses 36 direct the cooled coolant to the coolant pump 32 which forces the coolant back into the passageways and through the cooling circuit to cool the engine 10.

Pressure caused by the coolant pump 32 and heated coolant inside the cooling circuit is controlled by a valve cap 78. The valve cap 78 is disposed above the radiator 18 and covers a fill opening in the cooling circuit. As the coolant absorbs heat generated in the engine 10, it expands increasing the pressure in the cooling circuit. The valve cap 78 has an overflow tube (not shown) communicatively connected to an expansion tank 82. The expansion tank 82 receives excess coolant and gas in the cooling circuit which is vented through the valve cap 78. The expansion tank 82 is vented to allow the gas to escape to the surrounding atmosphere.

The cooling circuit operates most efficiently when it is filled with coolant. Advantageously, a supply tube 84 between the expansion tank 82 and the radiator hose 34 allows coolant in the expansion tank to 82 replenish the circuit when the circuit pressure drops. When the engine 10 stops operating, the coolant temperature drops creating a vacuum in the cooling circuit. The valve cap 78 allows coolant from the expansion tank 82 to flow back into the cooling circuit through the supply tube 84 replenishing the circuit for the coolant displaced due to expansion.

Air is forced through the radiator 18 to cool the coolant in the cooling circuit by the centrifugal fan 16 mounted on the engine vertical shaft 14 and above the cylinder block 12. Referring back to FIG. 1, the centrifugal fan 16 has a plurality of cupped fan blades 79 equidistantly spaced about a central fan axis 81. Outer edges 83 of the fan blades 79 define a fan diameter. Although equidistantly spaced fan blades are described, staggered fan blades may also be used without departing from the scope of the present invention.

Preferably, the fan blades 79 are formed part of a flywheel 86 which is mounted to the vertical shaft 14. Rotation of the vertical shaft 14 rotates the blades 79 about the fan central axis 81 drawing cooling air from the atmosphere in a generally axial direction toward the fan center. Air drawn into the fan center is propelled by the blades 79 in a generally radial direction toward the radiator 18. Although in a preferred embodiment, the fan 16 is formed part of the flywheel 86, the fan 16 may be independently mounted to the shaft 14 or mounted to a different shaft driven by a drive mechanism, such as a gear box or belt drive, mounted to a vertical or horizontal shaft engine without departing from the scope of the present invention.

The air duct 20 is mounted to the radiator 18 and is formed from conventional materials, such as plastic or metal. Although the air duct 20 as described herein is mounted to the radiator 18, the air duct 20 may be mounted to any suitable component or bracket of the engine 10, such as to the cylinder block 12 or bracket affixed thereto, without departing from the scope of the present invention.

Figure 7:
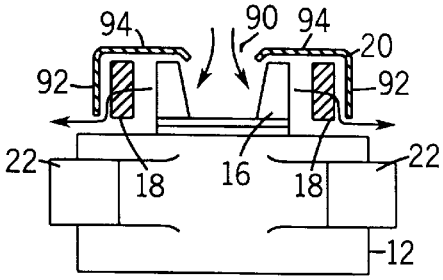
FIG. 7 is a cross sectional schematic view of the engine of FIG. 1.

Looking particularly at FIG. 7, the air duct 20 is shaped having a top plate 90 and downwardly depending sides 92 to enclose the fan 16 and radiator 18 and control the flow of cooling air into and out of the radiator 18. The fan 16 draws cooling air into the duct 20 through a circular aperture 94 formed in the top plate 90. Preferably, the circular aperture 94 has a diameter smaller than the fan diameter and is substantially concentric with the fan axis 81. By providing an aperture diameter smaller than the fan diameter, air is channeled into the fan center which increases the fan efficiency and minimizes any excess air from escaping in the axial direction, thus maximizing the cooling air which passes the radiator 18.

The duct downwardly depending sides 92 enclose a portion of the radiator 18 to deflect the air which has passed through the radiator 18 downward. Advantageously, by deflecting the air downward, the heated cooling air which has passed through the radiator airways is directed toward the engine 10 to further cool the cylinder block 12.

Figure 8:
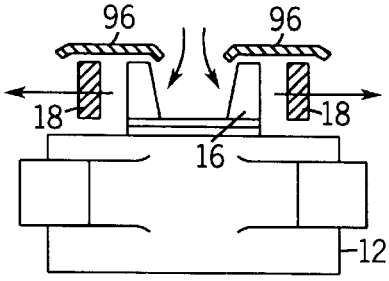
FIG. 8 is a cross sectional schematic view of the engine of FIG. 1 with a first alternate embodiment of the air duct.

The air duct 20 may be adapted to channel the air which has passed through the radiator 18 as desired for a particular application without departing from the scope of the present invention. For example, a first alternative air duct 96, shown in FIG. 8, is adapted to allow the cooling air to quickly dissipate into the atmosphere. The air duct 96 is disc shaped having an aperture as in the air duct 20 described above.

Figure 9:
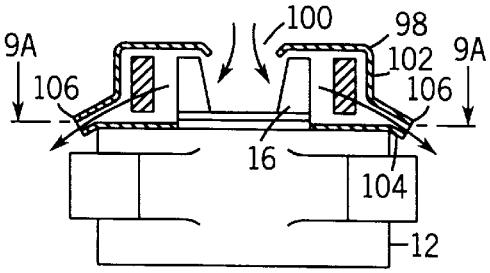
FIG. 9 is a cross sectional schematic view of the engine of FIG. 1 with a second alternate embodiment of the air duct.
Figure 9A:
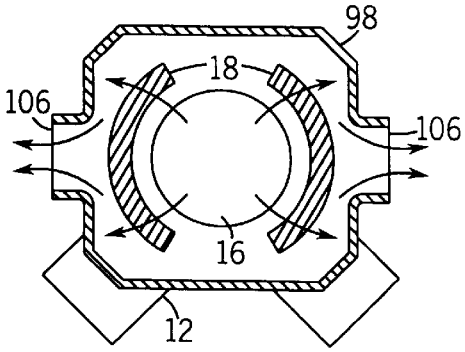
FIG. 9A is a sectional view of the air duct along line 9A—9A of FIG. 9.

The heated cooling air may also be directed to a convenient location away from the operator. In a second alternative, shown in FIGS. 9 and 9A, an air duct 98 having an aperture 100 and downwardly depending sides 102 mates with a base plate 104 disposed beneath the radiator 18. Two exhaust openings 106 formed in the air duct sides 102 direct the heated cooling air away from engine 10, and preferably, away from the engine operator. Although two exhaust openings are shown and described, in this alternative, there may be one or more openings without departing from the scope of the present invention.

Figure 10:
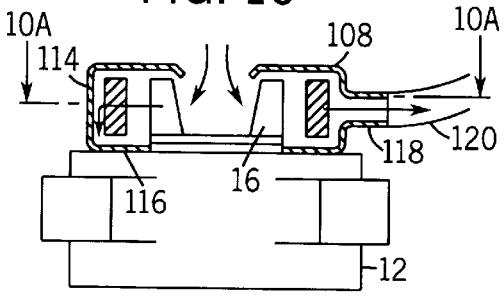
FIG. 10 is a cross sectional schematic view of the engine of FIG. 1 with a third alternate embodiment of the air duct.
Figure 10A:
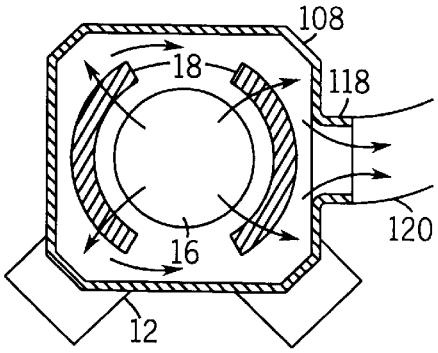
FIG. 10A is a sectional view of the air duct along line 10A—10A of FIG. 10.

Advantageously, as shown in FIGS. 10 and 10A, a third alternative similar to the second alternative is an air duct 108 having an aperture 112 and downwardly depending sides 114 which mate with a base plate 116. An exhaust port 118 formed in the duct side 114 is adapted to receive a hose 120 for directing the heated cooling air to a specific location, such as behind or above the operator.

Referring back to FIG. 1, a screen 110 placed over the aperture 94 further protects the radiator 18 and fan 16 by restricting the entry of debris through the aperture 94. As shown in FIG. 1, the screen 110 is mounted directly to the air duct 20 over the aperture 94. Alternative methods or devices may be used to control the entry of debris into the aperture 94, such as a grass screen which rotates with the cooling fan or other screening or chopping devices, without departing from the scope of the present invention.

In addition to alternate air ducts such as described above, encircling the fan 16 with two or more independent annular sections may be desired to provide cooling for other engine fluids or gases. For example, engine coolant may be cooled in an annular segment and lubricating oil may be cooled in a second annular segment, both segments forming part of an annulus encircling the fan 16. In addition to oil and coolant, other engine fluids or gases may also include hydraulic fluid, transmission fluid, brake fluid, and combustion air. It may also be desirable to only partially encircle the fan 16, such as in a shape of a segment of an annulus, if the entire surface area provided by completely encircling the fan 16 is not necessary to provide sufficient cooling.

While there has been shown and described what are at present considered the preferred embodiment of the invention, it will be obvious to those skilled in the art that various changes and modifications can be made therein without departing from the scope of the invention. For example, the radiator may be formed as described above or by any other suitable method of manufacturing, such as used by Long Manufacturing Company of Toronto, Canada.

Figure 11:
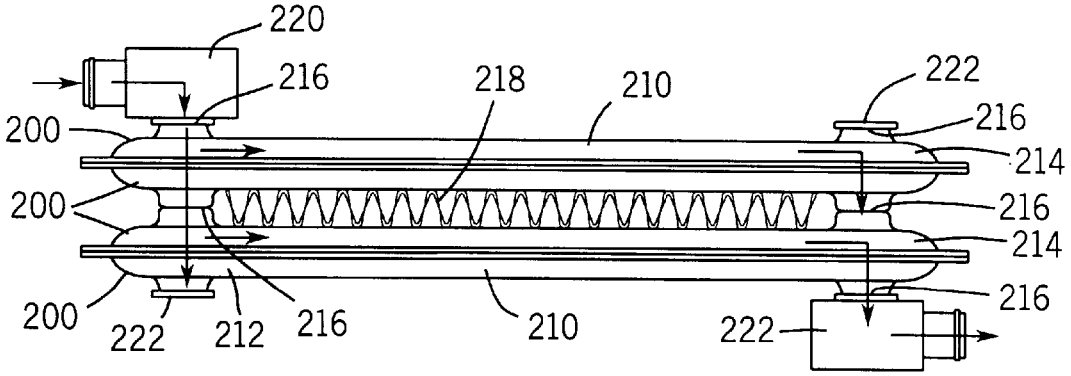
FIG. 11 is an elevational view of an alternative method of forming the radiator of FIG. 1.

As shown in FIG. 11, the Long Manufacturing method forms a plate 200 into a half of a coolant duct, and inlet and outlet plenum portions by stamping aluminum sheet metal. Pairs of these plates 200 are assembled to form the coolant passageway 210 and inlet plenum and outlet plenum portions 212, 214. A plurality of plate pairs are then stacked. Openings 216 formed at each plate end are communicatively connected to openings 216 in adjacent plate pairs to form the inlet and outlet plenums. Fins 218 made from folded aluminum sheet metal are placed in the space between the stacked plate pairs to increase the cooling surface area and improve heat transfer efficiency. The whole assembly is clamped and brazed together to form the completed radiator. Coolant enters and exits the radiator through fittings 220 fitted into the openings 216 not adjacent to plate pairs at each end of the stack. Caps 222 are placed over openings 216 which are not adjacent to a plate pair and not fitted with a fitting 220.

I claim:

1. A cooling apparatus for use with a liquid cooled internal combustion engine comprising:

a centrifugal fan having a central axis, said fan being driven by said engine, wherein said fan draws air from a substantially axial direction and expels said air in a substantially radial direction;

a radiator at least partially encircling said centrifugal fan in a path of said expelled air, said radiator having fluid heated by said engine flowing therethrough and airways extending outward from said centrifugal fan, wherein said expelled air passes through said airways to cool said fluid; and an air duct surrounding said radiator, wherein said fan draws said air into said duct and propels said air toward said airways, and said duct guides said propelled air toward said airways and guides said air exiting said airways away from said radiator.

2. A cooling apparatus as in claim 1, wherein said engine is a vertical shaft engine.

3. A cooling apparatus as in claim 2, wherein said centrifugal fan is mounted to said vertical shaft, said shaft and said fan rotating on a common axis.

4. A cooling apparatus as in claim 1, wherein said radiator is divided into two or more segments, each segment occupying a different sector around said fan.

5. A cooling apparatus as in claim 4, wherein a different fluid passes through each of said segments.

6. A cooling apparatus as in claim 5, wherein said different fluids are selected from the group consisting of engine coolant, oil, hydraulic fluid, transmission fluid, brake fluid, and combustion air.

7. A cooling apparatus as in claim 1, wherein said radiator is annular shaped.

8. A cooling apparatus as in claim 1, wherein said radiator is polygon shaped.

9. A cooling apparatus as in claim 1, wherein said radiator is dome shaped.

10. A cooling apparatus as in claim 1, wherein said radiator is conical shaped.

11. A cooling apparatus as in claim 1, wherein said centrifugal fan draws said air into said duct through an aperture formed in said duct.

12. A cooling apparatus as in claim 11, wherein said aperture has a diameter and said fan has a diameter, said aperture diameter being smaller than said fan diameter.

13. A cooling apparatus as in claim 1, wherein said duct guides said air exiting said airways toward a cylinder block of said engine.

14. A cooling apparatus as in claim 1, wherein said duct guides said air exiting said airways toward one or more exhaust openings formed in said duct.

15. A cooling apparatus as in claim 14, further comprising a hose communicatively connected to at least one of said exhaust openings.

16. A liquid cooled vertical shaft internal combustion engine having a cooling circuit for cooling said engine, said cooling circuit having a fluid flowing therethrough, said engine comprising:

a cylinder block having a vertical shaft and passageways, said passageways being part of said cooling circuit;

a centrifugal fan mounted adjacent the engine block and being driven by said vertical shaft for rotation about a vertical central axis, wherein said fan draws air from a substantially axial direction and expels said air in a substantially radial direction, a radiator mounted adjacent the cylinder block at least partially encircling said centrifugal fan in a path of said expelled air, said radiator being coupled to said cooling circuit for circulating cooling fluid therethrough;

an air duct surrounding said radiator for channeling said expelled air from said centrifugal fan toward said radiator, wherein said air passing said radiator cools said cooling fluid passing therethrough, and said duct further directs said air which has passed said radiator away from said radiator.

17. The engine as recited in claim 16, wherein said radiator has airways extending substantially radially away from said centrifugal fan, wherein said expelled air passes through said airways.

18. The engine as recited in claim 16, wherein said radiator includes two segments.

19. The engine as recited in claim 18, wherein said cooling fluid passes through one segment and a different fluid passes through the other of said segments.

20. The engine as recited in claim 20, wherein said different fluid is selected from the group consisting of oil, hydraulic fluid, transmission fluid, brake fluid, and combustion air.

21. The engine as recited in claim 16, wherein said radiator is annular shaped.

22. The engine as recited in claim 16, wherein said radiator is polygon shaped.

23. The engine as recited in claim 16, wherein said radiator is dome shaped.

24. The engine as recited in claim 16, wherein said radiator is conical shaped.

25. The engine as recited in claim 16, wherein said centrifugal fan draws said air into said duct through an aperture formed in said duct.

26. The engine as recited in claim 25, wherein said aperture has a diameter and said fan has a diameter, said aperture diameter being smaller than said fan diameter.

27. The engine as recited in claim 16, wherein said duct channels said air past said radiator and over the cylinder block of said engine.

28. The engine as recited in claim 16, wherein said duct channels said air past said radiator and toward one or more exhaust openings formed in said duct.

29. The engine as recited in claim 28, further comprising a hose communicatively connected to at least one of said exhaust openings.

* * * * *